US010545441B2

(12) United States Patent
Wazumi et al.

(10) Patent No.: US 10,545,441 B2
(45) Date of Patent: Jan. 28, 2020

(54) FIXING APPARATUS WHICH MOVES A ROLLER TO CHANGE A PEAK SURFACE PRESSURE AT A NIP PORTION, IMAGE FORMING APPARATUS, AND METHOD OF DESIGNING FIXING APPARATUS

(71) Applicant: KONICA MINOLTA, INC., Chiyoda-ku, Tokyo (JP)

(72) Inventors: Toshihiro Wazumi, Hachiouji (JP); Kazunori Nishinoue, Kunitachi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/050,263

(22) Filed: Jul. 31, 2018

(65) Prior Publication Data

US 2019/0064716 A1 Feb. 28, 2019

(30) Foreign Application Priority Data

Aug. 24, 2017 (JP) ..... 2017-161457

(51) Int. Cl.
*G03G 15/20* (2006.01)
*G03G 15/00* (2006.01)

(52) U.S. Cl.
CPC ..... *G03G 15/2064* (2013.01); *G03G 15/206* (2013.01); *G03G 15/2032* (2013.01); (Continued)

(58) Field of Classification Search
CPC ..... G03G 15/2064; G03G 15/2017; G03G 15/206; G03G 15/2032; G03G 15/5029; (Continued)

(56) References Cited

U.S. PATENT DOCUMENTS 9,971,288 B2 5/2018 Wazumi et al.
2009/0136273 A1* 5/2009 Kobayashi ..... G03G 15/2064 399/329

(Continued)

FOREIGN PATENT DOCUMENTS

JP 2012168265 A 9/2012

OTHER PUBLICATIONS

Extended European Search Report (EESR) dated Nov. 20, 2018 issued in counterpart European Application No. 18187466.0.

*Primary Examiner* — David M. Gray
*Assistant Examiner* — Laura Roth
(74) *Attorney, Agent, or Firm* — Holtz, Holtz & Volek PC

(57) ABSTRACT

A fixing apparatus includes a first pressing roller, a belt wound around the first pressing roller, a second pressing roller, and a roller position changer that changes a position of the second pressing roller. The second pressing roller faces the first pressing roller across the belt and forms a fixing nip portion between itself and the belt. At least one of the first pressing roller and the second pressing roller includes a core metal and a foam body covering the core metal. The roller position changer changes a position of the second pressing roller based on a kind of print medium to change a peak surface pressure of the fixing nip portion, such that a range where maximum shearing strain occurs from an interface between the core metal and the foam body in the foam body is a predetermined range.

8 Claims, 7 Drawing Sheets

(52) U.S. Cl.
CPC ..... *G03G 15/5029* (2013.01); *G03G 15/2017* (2013.01); *G03G 2215/00447* (2013.01); *G03G 2215/2032* (2013.01); *G03G 2215/2048* (2013.01)

(58) Field of Classification Search
CPC ... G03G 2215/2025; G03G 2215/2032; G03G 2215/2048; G03G 2215/00447
See application file for complete search history.

(56) References Cited

U.S. PATENT DOCUMENTS

2010/0166471 A1* 7/2010 Kikuchi ..... G03G 15/2028 399/331
2016/0170340 A1* 6/2016 Wazumi ..... G03G 15/2064 399/67

* cited by examiner

FIXING APPARATUS WHICH MOVES A ROLLER TO CHANGE A PEAK SURFACE PRESSURE AT A NIP PORTION, IMAGE FORMING APPARATUS, AND METHOD OF DESIGNING FIXING APPARATUS

CROSS-REFERENCE TO RELATED APPLICATION

The entire disclosure of Japanese patent application No. 2017-161457, filed on Aug. 24, 2017, is incorporated herein by reference in its entirety.

BACKGROUND

1. Technical Field

The present invention relates to a fixing apparatus, an image forming apparatus, and a method of designing a fixing apparatus, and in more detail, relates to a fixing apparatus that fixes a toner image formed on a print medium, an image forming apparatus including a fixing apparatus, and a method of designing a fixing apparatus.

2. Description of Related Arts

In recent years, in printing departments in corporates and print shops, electrophotographying system type image forming apparatuses called production printing machines have been used.

Even in the production printing machines, energy saving performance has been requested. In the fixing apparatus of the conventional image forming apparatus, there has been a technique that acquires energy saving effects owing to the shortening of warming up time by using a heat insulation type foam body including continuous air bubbles for a fixing roller or a pressing roller so as to make a heat capacity low. Furthermore, in order to prevent destruction of a foam body due to stress applied to a roller, there has been a technique that disposes a deformation preventer to prevent the deformation of the foam body on the end portions of a roller (refer to JP 2012-168265A)

SUMMARY

Since a foam body makes it possible to obtain a nip with a wide width at a low load, an area capable of heating and pressing for a sheet passing through a nip portion becomes large, and it becomes possible to make a sheet conveyance speed higher. On the other hand, by making the speed higher, the stress applied to the foam body also increases. For this reason, like the conventional technique, only by disposing the deformation preventer on the ends of a roller, it is difficult to prevent destruction due to stress, and there has been a problem in durability.

Then, an object of the present invention is to provide, in a fixing apparatus using a foam body for a roller, a fixing apparatus having improved durability. Moreover, another object of the present invention is to provide an image forming apparatus using a fixing apparatus having improved durability. Furthermore, another object of the present invention is to provide, in a fixing apparatus using a foam body for a roller, a method of designing a fixing apparatus having improved durability.

To achieve the above-mentioned object, a fixing apparatus reflecting one aspect of the present invention is a fixing apparatus, which includes a first pressing roller, a belt wound around the first pressing roller, a second pressing roller disposed so as to face the first pressing roller across the belt and to form a fixing nip portion between itself and the belt, and a roller position changer that changes a position of the second pressing roller, wherein at least one of the first pressing roller and the second pressing roller is a roller including a core metal and a foam body covering the core metal, and the roller position changer changes a position of the second pressing roller so as to be able to change a peak surface pressure of the fixing nip portion correspondingly to a kind of a print medium so that a range where maximum shearing strain occurs from an interface between the core metal and the foam body in the foam body becomes a predetermined range.

Moreover, a designing method reflecting one aspect of the present invention is a method of designing a fixing apparatus that includes a first pressing roller, a belt wound around the first pressing roller, and a second pressing roller disposed so as to face the first pressing roller across the belt and to form a fixing nip portion between itself and the belt. The method includes making at least one of the first pressing roller and the second pressing roller to a roller including a core metal and a foam body covering the core metal, and making a range where maximum shearing strain occurs from an interface between the core metal and the foam body in the foam body to a predetermined range by changing a hardness of the foam body or a thickness, from an interface between the core metal and the foam body to a surface of the roller, of the foam body.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
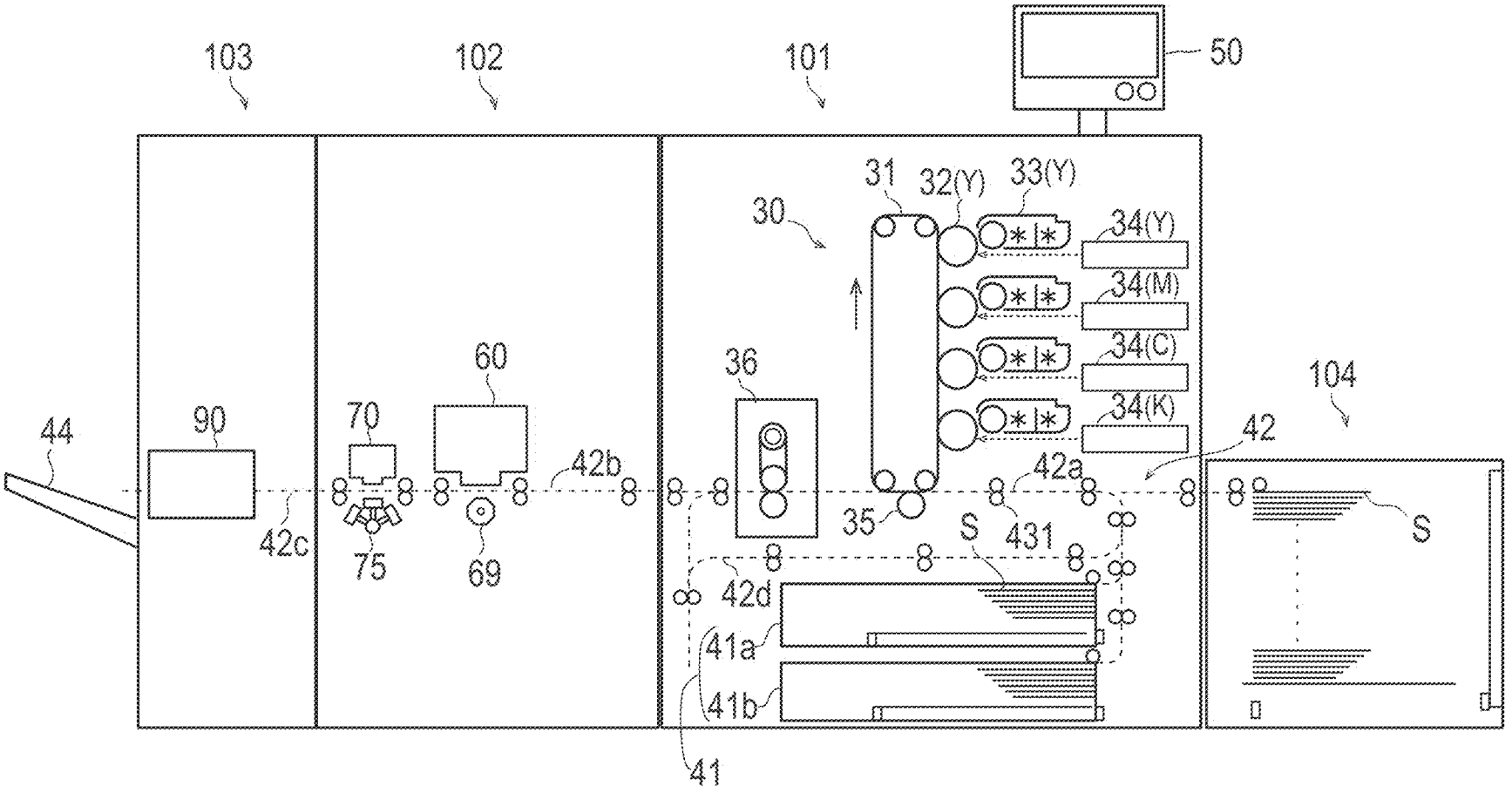
FIG. 1 is a schematic diagram showing a constitution of an image forming system according to one embodiment of the present invention.

Hereinafter, with reference to drawings, one or more embodiments of the present invention will be described in detail. In the description for the drawings, the same constitutional element is provided with the same reference symbol, and the overlapping description is omitted. Moreover, the dimensional ratios in the drawings are exaggerated on account of description, and, may be different from the actual ratios.

(Image Forming System)

Figure 2:
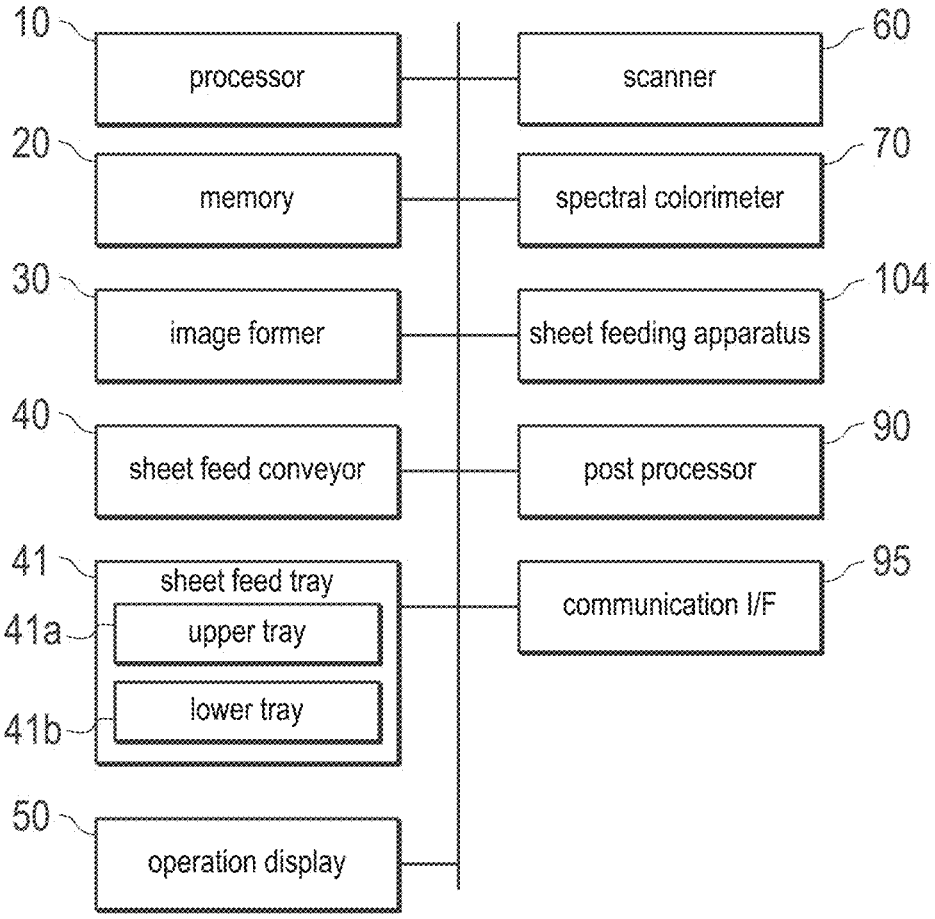
FIG. 2 is a block diagram showing a constitution of an image forming system.

FIG. 1 is a schematic diagram showing a constitution of an image forming system according to one embodiment of the present invention. FIG. 2 is a block diagram showing a constitution of an image forming system.

As image forming system 100 is a system referred to as a production printing machine. This image forming system 100 includes, if separating broadly, an image forming apparatus 101, a reading apparatus 102, a post processing apparatus 103, and a sheet feeding apparatus 104. The image forming apparatus 101 performs image formation (printing) for print media (for example, a paper sheet that may be referred to merely as a sheet). The reading apparatus 102 reads an image of a sheet after having been printed. The post processing apparatus 103 performs post processing for sheets after having been printed. The sheet feeding apparatus 104 stores sheets therein, together with a sheet feed tray 41, and, supplies sheets to an image former 30.

As shown in FIG. 2, the image forming system 100 includes a processor 10, a memory 20, the image former 30, a sheet feed conveyor 40, an operation display 50, a scanner 60, a spectral colorimeter 70, a post processor 90, and a communication I/F (interface) 95. These constitutional devices are connected with each other through buses for exchanging signals among them. Moreover, the sheet feeding apparatus 104 is also connected to the bus, and, performs transmission and reception of signals.

The processor 10 includes a CPU, and, performs control for each device and various kinds of arithmetic processing in accordance with programs. Moreover, the processor 10 also performs the control of a fixing apparatus (fixer) mentioned later.

The memory 20 includes a ROM that stores various programs and various kinds of data beforehand, a RAM that memorizes programs and data temporarily as a work region, a hard disk that stores various programs and various kinds of data, and the like.

The image former 30 includes an intermediate transfer belt 31, photoconductor drums 32, developers 33, writers 34, and a secondary transferer 35.

Each of the photoconductor drums 32, the developers 33, and the writers 34 includes the constitutions corresponding to the respective basic colors of yellow (Y), magenta (M), cyan (C), and black (K). In FIG. 1, with regard to the photoconductor drums 32 and the developers 33, the notation of reference symbols other than the reference symbols 32(Y) and 33(Y) are omitted.

The writer 34 of the image former 30 exposes the charged surface of the photoconductor drum 32 on the basis of image data, and, forms an electrostatic latent image. In the developer 33, the formed electrostatic latent image is developed with the toner of the developer 33, and the toner image of each of the basic colors is formed on the surface of a corresponding one of the photoconductor drums 32. The toner images of the basic colors are superimposed sequentially on the intermediate transfer belt 31 via the respective primary transferers (not shown) corresponding to the colors, whereby a full color toner image is formed. This toner image is transferred on a sheet S via the secondary transferer 35. Thereafter, the sheet S on which the toner image is formed, is conveyed to the fixing apparatus 36, and, is subjected to the heating and pressing processes in the fixing apparatus 36, whereby a full color image is fixed on the sheet S. The details of the fixing apparatus 36 will be mentioned later.

The sheet feed conveyor 40 includes a conveyance path 42 (42*a* to 42*d*), a plurality of conveyance rollers, a driving motor (not shown) to drive these rollers, and a sheet delivery tray 44.

The sheet feed conveyor 40 rotates the respective conveyance rollers at a predetermined timing by the driving of the driving motor, and, conveys the sheets S supplied from the sheet feeding apparatus 104 or the sheet feed tray 41 to the image forming section 30.

The conveyance path 42 includes conveyance paths 42*a* and 42*d* in the image former 30, a conveyance path 42*b* in the reading apparatus 102, and a conveyance path 42*c* in the post processor 90.

A sheet S fed out from the sheet feeding apparatus 104 or the sheet feed tray 41 is conveyed on the conveyance path 42*a*. On the conveyance path 42*a*, a registration roller 431 to adjust a conveyance timing of a sheet by rotating and stopping by a clutch is disposed.

The sheet S that has been conveyed on the conveyance path 42*a* and has been subjected to image formation by the image former 30, is subjected to respective processes corresponding to print settings of a print job via the conveyance paths 42*b* and 42*c* on the downstream side, subsequently, is delivered to the outside of the apparatus, and then is placed on the sheet delivery tray 44.

Moreover, in the case where the print setting of the print job is the setting for both-side printing, the sheet S on one side (a first surface, usually a front surface) of which the image formation has been performed, is conveyed to an ADU conveyance path 42*d* located on the lower side of the image former 30. The sheet S having been conveyed to this ADU conveyance path 42*d* is conveyed to a switch back route so that the front surface and back surface of the sheet is reversed. Thereafter, the sheet S joins the conveyance path 42*a*, and is subjected again to image formation onto another surface (a second surface, usually a back surface) in the image former 30.

The operation display 50 includes a display equipped with a touch panel, a ten key, a start button, a stop button, etc., and is used for inputting various kinds of settings, such as, printing conditions, an execution timing of adjustment of positions to be formed a front-side image and a back-side image, etc., for displaying a state of apparatus, and for inputting various kinds of instructions. Moreover, a user inputs an instruction for surface pressure adjustment (mentioned later) in the fixing apparatus 36 through the operation display 50. Moreover, a user inputs sheet information through the operation display 50. Examples of the sheet information include the kind of sheet (a regular paper sheet (high-quality paper sheet), a coated (coating) paper sheet, etc.), and the basic weight, thickness, size, etc. of a sheet. The sheet information having been input is correlated with the sheet feed tray 41 (respective trays 41*a* and 41*b*) or the sheet feeding apparatus 104, and then, is memorized in the memory 20.

The scanner 60 reads, on the conveyance path 42*b*, an image on the sheets S being passing through this conveyance path 42*b* after having been printed.

The processor 10 performs color adjustment and image position adjustment on the basis of image data acquired by the scanner 60. A Back face member 69 is disposed at a position to face the scanners 60 across the conveyance path 42*b*.

The scanner 60 includes a line image sensor, a lens optical system, an LED (Light Emitting Diode) light source, a casing to store these components, etc., and, reads an image printed on the sheet being conveyed. In the reading of an image, light from the LED light source is irradiated onto the surface of the sheet S being passing through the reading position on the conveyance path 42*b*. The image at this reading position is guided by the lens optical system, is made to form an image on a sensor array, and, is read out.

The spectral colorimeter 70 is, for example, a spectrometer, spectrally measures color patches formed on the sheet S which passes through between itself and the opposite member 75 arranged across the conveyance path 42*b*, and, acquires the spectral reflectance of each wavelength in a visible light region and in its neighborhood region. The colorimetry data is used, for example, for the color adjustment of an image to be printed.

The post processor 90 is disposed on the conveyance path 42*c*. The post processor 90 performs, for example, a binding process, and includes a stacker that stacks sheets and a stapler, thereby stacking a plurality of sheets S in the stacker, and thereafter, performing a side stitching process by using staples in the stapler. A bundle of sheets S having been subjected to the side stitching is delivered on the sheet delivery tray 44. Moreover, sheets S having been not subjected to the side stitching are delivered via the conveyance path 42*c* as they are.

In the communication interface 95, various kinds of local connecting interfaces, for example, network interfaces according to standards such as SATA, PCI Expres, USB, Ethernet (registered trademark), and IEEE 1394, and wireless communication interfaces such as Bluetooth (registered trademark), and IEEE 802.11, etc. may be used. A print job including print data and print setting is received from external terminals, such as PC and the like through the communication interface 95.

The sheet feed tray 41 is made here a two stage drawer type tray including an upper tray 41*a* and a lower tray 41*b*, stores sheets separately in these trays, and supplies sheets to the image forming apparatus 101.

The sheet feeding apparatus 104 stores many sheets more than each of the trays 41*a* and 41*b* in the inside of the image forming apparatus 101, and, supplies sheets to the image forming apparatus 101. However, without being limited to the above, the sheet feeding apparatus 104 may include a multi stage type tray, and, may be made to be able to store sheets individually to each tray.

In many cases, the sheet feed tray 41 and the sheet feeding apparatus 104 are used so as to store the respective different kinds of sheets from each other. For example, regular paper sheets and coated paper sheets, or sheets different in size or basic weight even in regular paper sheets or coated paper sheets, are separately stored in the sheet feed tray 41 and the sheet feeding apparatus 104, and then, are used separately.

Incidentally, any or all of the reading apparatus 102, the post processing apparatus 103, and the sheet feeding apparatus 104 may not be included in the image forming system, and, may be linked to the image forming apparatus 101 in order to attain functions desired by a user as the image forming system.

(Fixing Apparatus)

Figure 3:
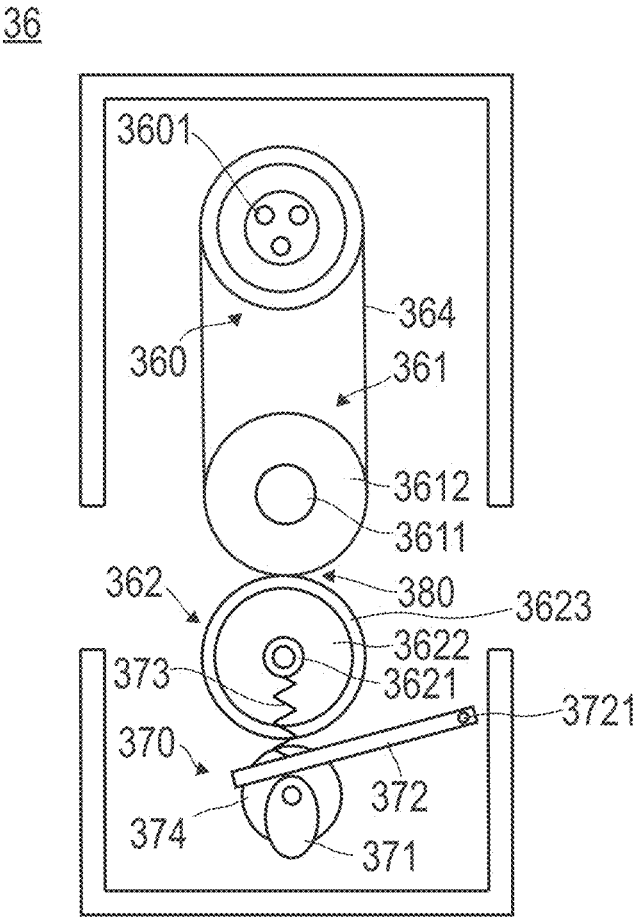
FIG. 3 is a side view for describing a fixing apparatus.

FIG. 3 is a side view for describing the fixing apparatus 36.

The fixing apparatus 36 is a belt type fixing apparatus. The fixing apparatus 36 includes a heating roller 360, an upper pressing roller 361 (first pressing roller), a lower pressing roller 362 (second pressing roller), a belt 364, and a roller position changer 370.

In this fixing apparatus 36, the lower pressing roller 362 is disposed across the endless belt 364 that is hooked, or, wound around the upper pressing roller 361. A fixing nip portion (hereinafter, merely referred to as a nip portion 380) is formed between this lower pressing roller 362 and the belt 364. The upper pressing roller 361 and the lower pressing roller 362 rotate synchronously, and, a sheet is made to pass between the lower pressing roller 362 and the belt 364, whereby a toner image is fixed onto the sheet.

The heating roller 360 includes a heater 3601 in its inside. The heater 3601 is controlled by the processor 10 so that a temperature detected by a temperature sensor (not illustrated) disposed in the vicinity of the nip portion 380 becomes a proper temperature.

The upper pressing roller 361 includes a core metal 3611 and a foam body 3612 covering the circumference of the core metal 3611. The foam body 3612 is one in which silicone rubber has been made to foam continuously, and is excellent in heat resistance. It is preferable that this foam body 3612 includes continuous air bubbles (open-cell) with a cell diameter of 1 to 50 μm. Moreover, it is preferable that the foam body 3612 has a thickness (a distance in the radial direction from the interface between the core metal 3611 and the foam body 3612 to the surface of the foam body 3612) of 10 to 30 mm. Moreover, it is preferable that the upper pressing roller 361 has an outside diameter of 50 to 70 mm. By using the foam body 3612 made to have such a cell diameter, thickness, and outside diameter, even in the case of changing a surface pressure on the nip portion 380 as mentioned later, it is possible to perform a fixing operation to enable an image quality to become good. The core metal 3611 and the foam body 3612 are bonded fixedly (bonding with a bonding agent, etc.).

The position of each of the heating roller 360 and the upper pressing roller 361 is fixed. The belt 364 is hooked, or, wound around the heating roller 360 and the upper pressing roller 361 so as to exhibit a certain tension. The heating roller 360 rotates along with rotation of the upper pressing roller 361.

The lower pressing roller 362 includes a metal rotating body 3622 around the circumference of a shaft 3621 and an elastic body 3623 that covers the circumference of the rotating body 3622. The elastic body 3623 is, for example, a non-foamed silicone rubber. It is preferable that the lower pressing roller 362 has an outside diameter of 50 to 70 mm similarly to the upper pressing roller 361.

The roller position changer 370 includes a cam 371 that has a drive shaft attached eccentrically, a holder 372 that moves close to or away from the upper pressing roller 361 along with the movement of this cam 371, and an elastic material 373 connected to the holder 372 and the shaft 3621 of the lower pressing roller 362. The holder 372 rotates around a fixed shaft 3721 disposed at one end of the holder 372. The elastic material 373 is, for example, a spring. The cam 371, the holder 372, and the elastic material 373 are disposed on the both ends (or, positions that are near the both ends and are separated away from the fixing nip portion) of the shaft 3621 of the lower pressing roller 362.

The roller position changer 370 includes a motor 374 that is connected with the drive shaft of the cam 371 disposed on each of the both ends of the shaft. Owing to the movement of the motor 374, the cams 371 disposed on the both ends of the shaft perform the same movement, whereby the roller position changer 370 moves the position of the lower pressing roller 362 close to or away from the upper pressing roller 361. With this, a pressing force from the lower pressing roller 362 to the upper pressing roller 361 is changed, whereby the surface pressure of the nip portion 380 can be adjusted. As the motor 374, it is preferable to use a motor 374 capable of performing accurate positioning control, such as a stepping motor. This motor 374 can stop the movement of the cam 371 by being excited in a stopped state.

The operation of the motor 374 is controlled by the processor 10. For example, the peak surface pressure (mentioned later) of the nip portion 380 obtained from the rotation angle of the motor 374 is memorized beforehand in the memory 20, for example as table data and the like. Then, upon supply of electric power to the image forming apparatus 101, the processor 10 makes, with reference to the memory 20, the motor 374 rotate up to a position where a surface pressure becomes a designated surface pressure, and, makes the motor 374 stop at the position. By maintaining the excited state (energized state) at the stop position, the motor 374 is stopped at the position. With this, a desired peak surface pressure can be obtained. The relationship between the rotation angle of the motor 374 and the peak surface pressure of the nip portion 380 has been actually measured beforehand, and, is memorized in the memory 20. In this connection, a brake may be disposed so as to keep the cam 371 at the stop position so that it is not required to continue the exciting of the motor after the positioning of the motor 374 has been stopped.

When a sheet passes through the nip portion 380, the lower pressing roller 362 moves downward correspondingly to the thickness of the sheet. Then, after the sheet has passed over, in order to return the lower pressing roller 362 to the original position, the holder 372 and the elastic material 373 are disposed.

Description is given for the control of the peak surface pressure of the nip portion 380 in the fixing apparatus 36, constituted as mentioned in the above, according to the present embodiment.

Figure 4:
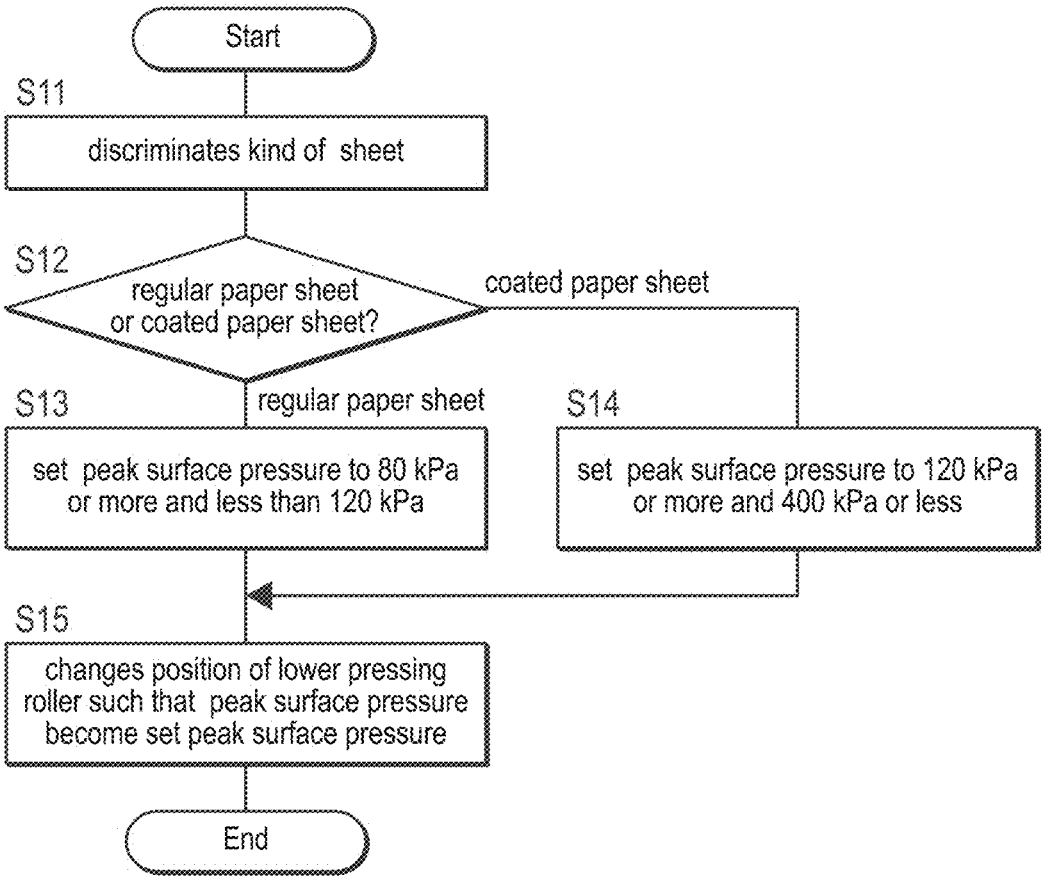
FIG. 4 is a flowchart showing procedures for changing a peak surface pressure of a nip portion in a fixing apparatus.

The fixing apparatus 36 according to the present embodiment changes the peak surface pressure of the nip portion 380 in the fixing apparatus 36 correspondingly to the kind of a print medium. FIG. 4 is a flowchart showing procedures for changing the peak surface pressure of the nip portion in the fixing apparatus 36.

The peak surface pressure (hereinafter, merely referred to as a peak surface pressure) of the nip portion 380 of the fixing apparatus 36 means the maximum value of the surface pressure of the nip portion 380 in the nip width direction (namely, the sheet conveyance direction).

First, the processor 10 discriminates the kind of a sheet (sheet kind) to be printed (S11). Here, as the sheet kind, the processor 10 discriminates whether a sheet is a regular paper sheet or a coated paper sheet. The sheet kind is acquired from the information in a job to be printed, or the information on sheets stored in the sheet feed tray 41 and the sheet feeding apparatus 104. The information on the sheet stored in the sheet feed tray 41 and the sheet feeding apparatus 104 is set when storing sheets in the sheet feed tray 41 and the sheet feeding apparatus 104, and, is memorized in the memory 20. Moreover, the sheet kind may be acquired by an input (an input from the operation display 50) from a user in the stage of S11.

Successively, the processor 10 sets a peak surface pressure (S13 or S14) depending on whether the discriminated sheet kind is a regular paper sheet or a coated paper sheet (S12). The peak surface pressure corresponding to a sheet kind is determined in consideration of the durability of the foam body 3612, and is memorized in the memory 20 beforehand. With regard to the relationship between the surface pressure and the durability, its details are clarified by the later-mentioned examples. Herein, an outline is described. That is, strain due to stress is applied from the interface between the core metal 3611 of the upper pressing roller 361 and the foam body 3612 in the direction toward the inside of the foam body. This strain causes the lowering of durability. In the case where an imaginary line segment drawn from the rotation center of the upper pressing roller 361 to the rotation center of the lower pressing roller 362 is made as a center line, a range where this strain occurs is a range between a line segment drawn from the center of the upper pressing roller 361 including the foam body 3612 in a direction at 45 degrees on a upstream side in the rotation direction of the upper pressing roller 361 than the imaginary line segment and a line segment drawn from the center of the upper pressing roller 361 in a direction at 45 degrees on a downstream side (a range within 90 degrees from the upstream side to the downstream side around the imaginary line as the center). A peak surface pressure is adjusted such that the maximum shearing strain in this range becomes 0.50 or less in a stationary state. With this, the durability of the upper pressing roller 361 using the foam body 3612 is improved.

In the present embodiment, as a peak surface pressure corresponding to a sheet kind, for example, for a regular paper sheet, the peak surface pressure is set to 80 kPa or more and less than 120 kPa (S13), and for a coated paper sheet, the peak surface pressure is set to 120 kPa or more and 400 kPa or less (S14).

Successively, the processor 10 changes the position of the lower pressing roller 362 such that a peak surface pressure becomes the set peak surface pressure (S15). With regard to the changing of the position of the lower pressing roller 362, as having already explained, the position of the lower pressing roller 362 is changed by driving the motor 374 and rotating the cam 371 with reference to the table memorized in the memory 20 so as to become the set peak surface pressure. With this, the process for controlling the peak surface pressure is ended.

Subsequently, in accordance with the job to be printed, image formation is performed, and fixing by the fixing apparatus 36 is also performed.

With this, a peak surface pressure applied to the nip portion 380 is decided in consideration of durability, and the peak surface pressure becomes a proper surface pressure corresponding to a sheet kind. Accordingly, durability can be improved without causing deterioration of image quality.

EXAMPLE

An experimental apparatus similar to the fixing apparatus 36 in the embodiment was manufactured, and various experiments were conducted.

(Surface Pressure)

Energy saving can be improved by using the foam body 3612 for the upper pressing roller 361 as similar to the conventional technology. However, in the case of using the foam body 3612 for the upper pressing roller 361, there is a disadvantage that the surface pressure lowers as compared with the non-foamed silicone rubber roller. This lowering of the surface pressure particularly influences in the case of a coated paper sheet. In the case of a coated paper sheet, if the coated paper sheet is made to pass through under a low surface pressure similar to a regular paper sheet, a phenomenon called toner blister occurs. The toner blister is a phenomenon in which moisture, vaporized and expanded by heating at the time of fixing, in toner and air in a toner layer escape from the surface of a melted toner layer as fine bubbles, because escaping passages of the expanded moisture and the air to the paper substrate side are blocked by the coated layer. If the toner blister occurs, the image becomes rough, and the image quality lowers.

On the other hand, at the time of using a coated paper sheet, if the surface pressure is made high too much in order to avoid the toner blister, problems may arise in such a manner that sheet deforms, or images become glare due to too high gloss. Moreover, if surface pressure is made high, it becomes a cause of shortening the life of the foam body 3612.

Then, an experimental apparatus (fixing apparatus) similar to the fixing apparatus 36 of the above-described embodiment was actually manufactured, and the relationship between the surface pressure and image quality was investigated. For this, the following experimental apparatus 1 was manufactured, and the experiment was performed.

Upper pressing roller: outside diameter ϕ 60 mm, thickness 15 mm, a foam body 3612 made of a silicone rubber with a cell diameter 30 μm, AskerC hardness 30 degrees (sponge manufactured by SYNZTEC, Co., LTD.), Lower pressing roller: outside diameter ϕ 60 mm, thickness 2 mm, made of a silicone rubber (non-foamed), a surface layer PFA tube (JISA hardness 30 degrees) (perfluoroalkoxy fluorine resin (abbreviation: PFA)), Belt: outside diameter ϕ 99 mm, 70 μm thick polyimide substrate, thickness 200 μm silicone rubber, surface layer PFA tube, Fixing load: 1000 N, Belt tension: 20 N on each of both ends of a shaft, sum total 40 N.

The measuring instrument used for measurement of the surface pressure of the nip portion 380 is a measurement system PINCH A3-40 for pressure distribution between rollers (manufactured by NITTA Co., LTD.).

Here, a peak surface pressure means the highest value (namely, peak value) among the surface pressures measured with the above-mentioned measuring instrument. On the other hand, an item described merely as a surface pressure is a pressure ($N/m^2$=Pa) obtained by dividing the above-mentioned fixing load by an area according to a nip width and a nip length (length in the roller axis direction) in the nip portion 380.

In the experiment that investigated the relationship between the surface pressure and the image quality, the same image was printed on a regular paper sheet and a coated paper sheet by changing the peak surface pressure, and the image quality at that time was checked by visual observation. In the measurement of a peak surface pressure, the peak surface pressure was the value measured in the stationary state by using the above-mentioned measuring instrument. The sheet conveyance speed at the time of image formation (printing) was set to 340 mm/s. The results are shown in Table 1.

In Table 1, "A" represents good image quality, "B" represents image quality in which deformation of a sheet occurred on a part of the sheet, or the gloss was too high, and "C" represents image quality in which the image quality was rough due to toner blister. Moreover, in the item of "remarks", "office machine" represents a printer of an office use, "PP machine" represents a production printing machine, and each of "standard surface pressure", "upper limit surface pressure", and "lower limit surface pressure" represents a peak surface pressure.

TABLE 1

| peak surface pressure (kPa) | 80 | 100 | 110 | 120 | 130 | 200 | 400 | 410 |
|---|---|---|---|---|---|---|---|---|
| regular paper sheet | A | A | A | A | A | A | A | B |
| coated paper sheet | C | C | C | A | A | A | A | B |
| remarks | standard surface pressure in office machine | upper limit of surface pressure in office machine | | lower limit of surface pressure in PP machine | | | upper limit of surface pressure in PP machine | |

As shown in Table 1, in the regular paper sheet, good image quality is obtained from 80 kPa being the standard peak surface pressures of the office machine to 400 kPa being the upper limit peak surface pressures of the production printing machine. However, even in the regular paper sheet, at 410 kPa being high to an extent exceeding the upper limit surface pressure of the production printing machine, the lowering of image quality, such as sheet deformation and gloss being too high, was observed.

On the other hand, in the coated paper sheet, in the case of 110 kPa or less, it was observed that an image becomes rough. This is typical image quality when toner blister occurred. Image quality with no problem is obtained from 120 kPa being the lower limit peak surface pressures of the production printing machine to 400 kPa being an upper limit peak surface pressure. At 410 kPa being further high, even in the coated paper sheet, the lowering of image quality, such as sheet deformation or gloss being too high, was observed.

From the above matters, it turned out that the peak surface pressure to obtain good image quality is 80 to 400 kPa in the regular paper sheet and 120 to 400 kPa in the coated paper sheet.

(Nip Width)

Next, the investigation was conducted about the nip width.

As an advantage in the case of using the foam body 3612 for the upper pressing roller 361, a wide nip width can be attained with a low load. A heating amount for a sheet is determined by multiplication of a speed and a nip width. The heating amount to a sheet is determined by multiplication of a speed and a nip width. In the production printing machine, in order to improve the image quality than that of the printer having been used so far in the office etc., coloring is performed by making much more toner adhere onto a sheet. As a toner adhesion amount is larger, a more heating amount is required in order to fix onto the sheet. Moreover, high speed printing is also requested in the production printing machine. For this reason, if the speed is increased, the nip width becomes insufficient, and the heating amount becomes insufficient. Accordingly, there is a possibility that fixing failure occurs. Then, the relationship between the adhesion amount of toner and the nip width was investigated.

An experimental apparatus had the constitution as described in the above. In the case of increasing the fixing load (the surface pressure of the entire nip portion 380), the nip width becomes wide, and in the case of decreasing it, the nip width becomes narrow. The experiment was performed by changing the nip width with a different toner amount for a coated paper sheet. The same image was printed with a toner amount (adhesion amount in office machine in Table 2)

having been used in many cases in the office-use printer and a toner amount (adhesion amount in PP machine in Table 2) in the production printing machine using toner more than the above, and the printed images were evaluated by visual observation. A sheet conveyance speed is the same as that in the above. The results are shown in Table 2.

In Table 2, "A" represents good image quality without toner peeling-off, "B" represents that rotation torque became large (no toner peeling-off), and "C" represents that there was toner peeling-off. Moreover, in the item of "remarks", each of "standard width", "upper limit width", and "lower limit width" represents a nip width.

TABLE 2

| nip width (mm) | 12 | 15 | 16 | 17 | 18 | 30 | 31 |
|---|---|---|---|---|---|---|---|
| adhesion amount in PP machine | C | C | A | A | A | A | B |
| adhesion amount in office machine | A | A | B | B | B | B | B |
| remarks | standard width in office machine | upper limit width in office machine | lower limit width in PP machine | | | upper limit width in PP machine | |

As shown in Table 2, in adhesion amount in PP machine, the toner peeling-off was observed in the nip width of 12 to 15 mm. On the other hand, in adhesion amount in office machine, even in the nip width of 12 to 15 mm, there was no toner peeling-off. In the case of making the nip width wider, in adhesion amount in PP machine, also, in adhesion amount in office machine, in the nip width of 16 to 30 mm, there was no toner peeling-off. However, in adhesion amount in office machine, the torque became larger than the torque as an office-use printer. In the case of making the nip width further wider, in adhesion amount in PP machine, also, in adhesion amount in office machine, in the nip width of 31 mm, there was no toner peeling-off, however, the both of them became to need the larger torque.

From these matters, in the office-use printer or even in the production printing machine, in the case of a toner amount to an extent used in office-use, the necessary nip width is 12 to 15 mm, and in the case where it is permissible that the torque becomes larger, it turns out that it is permissible up to 30 mm. On the other hand, it turned out that, in the case of a toner amount in the production printing machine, the necessary nip width becomes 16 to 30 mm.

(Destruction Test)

Next, the above-mentioned experimental apparatus 1 was driven with a high surface pressure (exceeding a peak surface pressure of 410 kPa) and a wide nip width (exceeding 31 mm) each made to an extent not used in the usual office-use printer. As a result, the foam body of the upper pressing roller 361 was destroyed in about ¼ of a target life (the number of times of nipping (later-mentioned) 3,500,000) (refer to the following endurance test). As a result of having observed the situation of the destruction at this time, it turned out that the destruction progresses from the interface (bonding portion) between the core metal 3611 and the foam body 3612.

(Cae Analysis)

The deformation of the foam body 3612 of the upper pressing roller 361 was analyzed by the CAE (Computer Aided Engineering) analysis. The CAE analysis was performed by setting the following analysis conditions using ANSYS.

Upper pressing roller: outside diameter ϕ 50 mm, thickness 10 mm, a silicone rubber foam body with a cell diameter 30 μm (AskerC hardness 25 degrees (manufactured by SYNZTEC, Co., LTD. sponge), Lower pressing roller: outside diameter ϕ 60 mm, thickness 2 mm, a silicone rubber, a surface layer PFA tube (JISA hardness 30 degrees), Belt: outside diameter ϕ 99 mm, 70 μm thick polyimide substrate, thickness 200 μm silicone rubber, surface layer PFA tube, Fixing load: 1400 N, Belt tension: 20 N on each of both ends of a shaft, sum total 40 N.

(Destruction Test)

Figure 5:
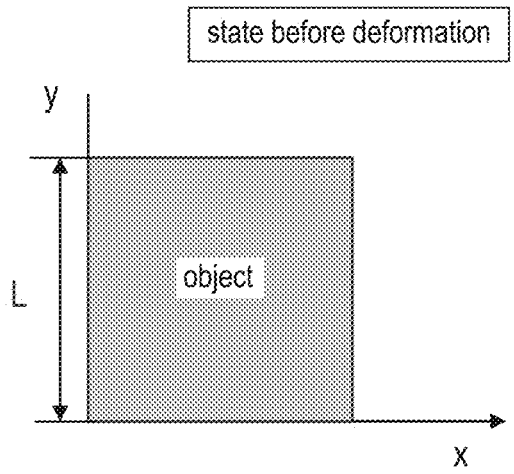
FIG. 5 is an explanatory illustration for describing shearing strain.
Figure 6:
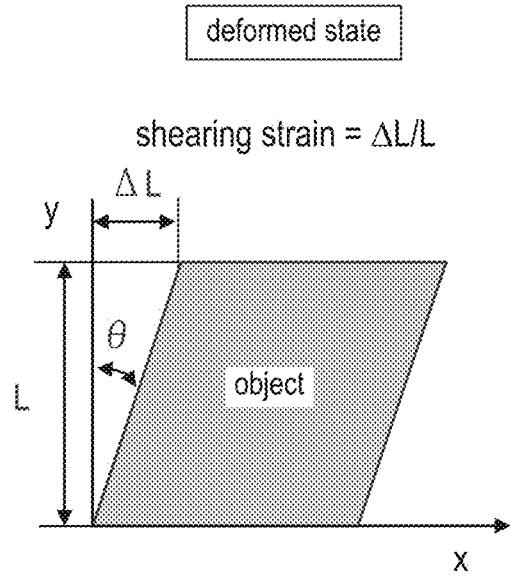
FIG. 6 is an explanatory illustration for describing shearing strain.

For description of the analysis results, herein, the maximum shearing strain is described. FIG. 5 and FIG. 6 are explanatory illustration for describing the shearing strain.

FIG. 5 shows a state before deformation of an object. That is, the object does not deform in both the x direction and the y direction. The strain has not occurred in this state. FIG. 6 shows a state where the object has deformed. That is, the object is in a state where the y direction lower portion was fixed and the y direction upper portion has deformed in the x direction. The deformation amount is ΔL. At this time, the shearing strain of ΔL/L has occurred on this object. Then, a value when θ=45 degrees in FIG. 6, is called the maximum shearing strain. Here, L is a length of the object from the lower end to the upper end in the y direction.

Figure 7:
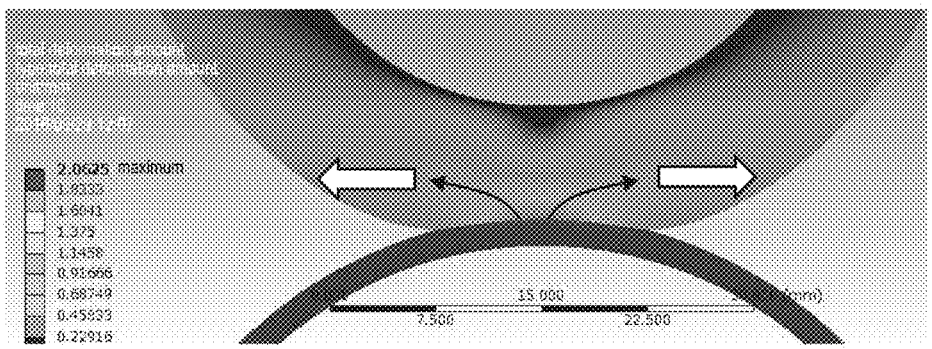
FIG. 7 is an analysis diagram that was displayed on a display and shows a deformation amount being a result of a tensile force analysis by CAE.

FIG. 7 is an analysis diagram that was displayed on a display and shows a deformation amount being the result of the tensile force analysis by the CAE.

In the case of using the foam body 3612 having elasticity for the upper pressing roller 361, it has been thought until now that the foam body portion of the upper pressing roller 361 pushed by the lower pressing roller 362 is going to merely collapse upward. However, as a result of the CAE analysis, it turns out that, as shown with white arrow heads in FIG. 7, the foam body portion not only collapses, but also is pushed out so as to spread sideways due to tensile forces acting in such directions.

Figure 8:
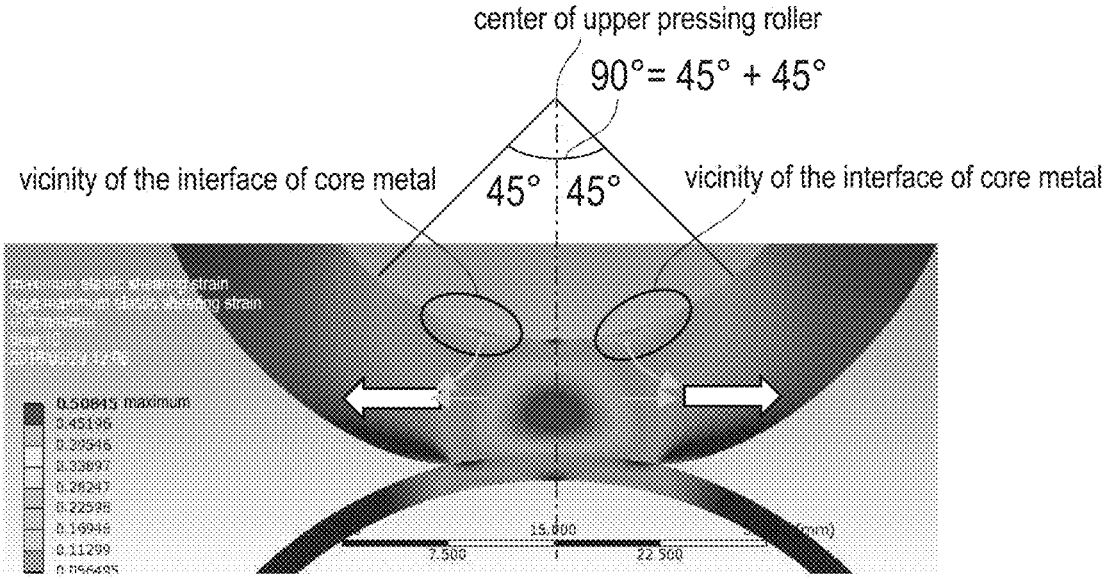
FIG. 8 is an analysis diagram that was displayed on a display and shows a maximum elastic shearing strain being a result of a shearing strain analysis by CAE.

Successively, the analysis of the shearing strain caused by the above-described deformation was performed. The analysis assumes a state where the roller is standing still. FIG. 8 is an analysis diagram that was displayed on a display and shows the maximum elastic shearing strain being a result of the shearing strain analysis by the CAE.

As a result of the analysis of the shearing strain, it turned out that as shown in FIG. 8, a range which the maximum shearing strain acts in the vicinity of the interface between the foam body 3612 and the core metal 3611, is a range between a line segment (a solid line in FIG. 8) drawn from the center of the upper pressing roller 361 including the foam body 3612 in a direction at 45 degrees on an upstream side in the rotation direction of the upper pressing roller 361 than an imaginary line segment (a one-dot broken line) and a line segment (a solid line in FIG. 8) drawn from the center of the upper pressing roller 361 in a direction at 45 degrees on a downstream side (a range of 90 degrees from the upstream side to the downstream side around the imaginary line as the center).

Moreover, as a result of this analysis, it became clear that the shearing strain has accumulated greatly not only on the center portion (radial direction) of the foam body 3612 but also on the interface between the foam body 3612 and the core metal 3611. In the experiment using the test apparatus, this is coincident with the observation result in which the destruction of the foam body 3612 was advancing from the interface portion of the core metal. Then, the maximum shearing strain and the durability of the core metal interface were investigated.

(Endurance Test)

In order to investigate the maximum shearing strain and the durability of the foam body 3612 on the core metal interface, a plurality of experimental apparatuses 2 in which the constitution was changed as follows were prepared, and the endurance test was performed.

- Upper pressing roller: a foam body 3612 made of a silicone rubber with a cell diameter 30 μm was used, the thickness and hardness (AskerC) of the foam body 3612 and a roller outside diameter were as shown in Table 3 (manufactured by SYNZTEC, Co., LTD. sponge),
- Lower pressing roller: thickness 2 mm, made of a silicone rubber (non-foamed), a surface layer PFA tube (JISA hardness 30 degrees), a roller outside diameter was as shown in Table 3,
- Belt: outside diameter ϕ 99 mm, 70 μm thick polyimide substrate, thickness 200 μm silicone rubber, surface layer PFA tube,
- Fixing load was adjusted such that a peak surface pressure becomes a surface pressure shown in Table 3,
- Belt tension: 20 N on each of both ends of a shaft, sum total 40 N.

The results of the endurance test are shown in Table 3. In Table 3, an inter-axial distance (mm) is a distance from the center of the upper pressing roller 361 to the center of the lower pressing roller 362, and in the above-mentioned embodiment, the position of the lower pressing roller 362 is changed by the roller position changer 370. The number of times of nipping means how many times one point on the surface of the upper pressing roller 361 has passed through the nip portion 380, and it is the same with the number of rotations. Therefore, a destruction nipping number in Table 3 is the number of times of nipping (the number of rotations) until resulting to destruction. Moreover, in Table 3, the maximum shearing strain was obtained in accordance with the above-described definition among the shearing strains, obtained by the simulation, that arise from the interface between the core metal 3611 and the foam body 3612 in the direction toward the inside of the foam body.

Figure 9:
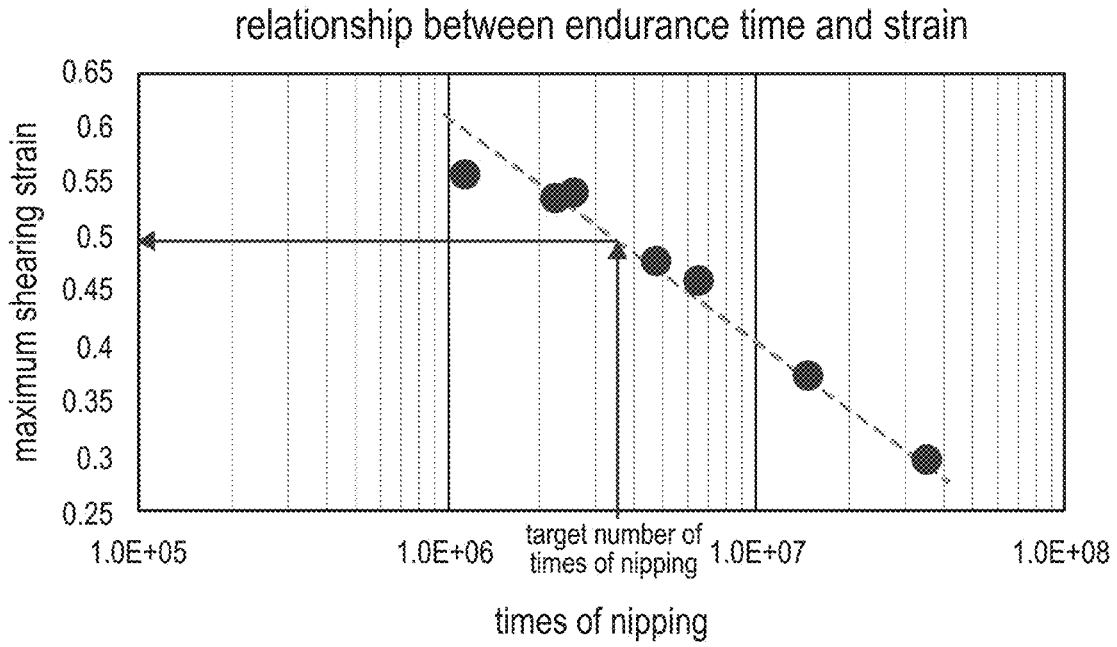
FIG. 9 is a graph showing a relationship between endurance time and strain.
Figure 10:
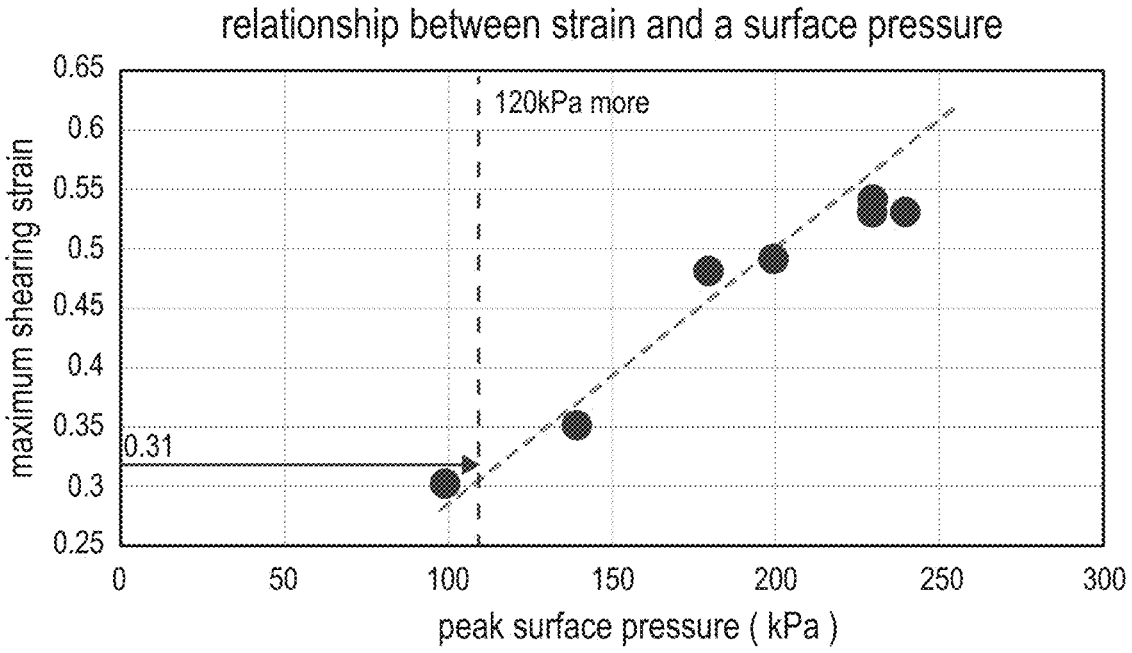
FIG. 10 is a graph showing a relationship between strain and a surface pressure.

This relationship between endurance time and strain has been summarized in a graph. FIG. 9 is a graph showing the relationship between endurance time and the maximum shearing strain. FIG. 10 is a graph showing the relationship between the maximum shearing strain and a surface pressure. Any of the maximum shearing strains are the values of the analysis results in the stationary state.

From these results, in the case where a target number of times of nipping (a target value of durability) is made to 3,500,000 times, in Comparative Example 1, the maximum shearing strain in the vicinity of the interface is 0.54, and, the destruction nipping number has become about ⅓ of the target number of times of nipping. Moreover, as in Comparative Examples 2 and 3, it turns out that, by making the maximum shearing strain in the vicinity of the interface of the core metal smaller, the durability has been improved. Furthermore, in Example 1 in which the maximum shearing strain becomes 0.50 or less, a number of times of nipping has exceeded the target value.

Moreover, in the relationship between strain and a surface pressure, for example, at 100 kPa of the peak surface pressure upper limit in the case of using a regular paper sheet, the maximum shearing strain becomes a low value of about 0.3. On the other hand, in the case of making the surface pressure to 120 kPa or more that is a lower limit of a peak surface pressure of a coated paper sheet, the maximum shearing strain becomes 0.31 or more.

From this matter, it turns out that in the case of using a regular paper sheet, even if utilizing at the upper limit of the peak surface pressure of the regular paper sheet, the durability becomes very high. Moreover, in the case of using a coated paper sheet, from the surface pressure of the coated paper sheet and the results of the endurance test, it turns out that it is preferable that the maximum shearing strain is used between 0.31 and 0.50.

Moreover, from the results of the endurance test, it turns out that even if the characteristics of the foam body 3612, such as a roller diameter, the hardness of the foam body 3612, and the thickness of the foam body 3612, are different, the maximum shearing strain can be adjusted by changing a peak surface pressure. Moreover, conversely, by changing the characteristics of the foam body 3612 and the mechanical constitution, such as the roller diameter, also, the maximum shearing strain can be adjusted.

Therefore, in order to improve the durability of a fixing apparatus, it is to change the maximum shearing strain depending on the kind of print media, i.e., a difference whether it is a regular paper sheet or a coated paper sheet. In order to make it become the maximum shearing strain, a peak surface pressure is changed correspondingly to the kind

TABLE 3

| | thickness of foam body (μm) | hardness of foam body | outside diameter/(mm) lower pressing roller | outside diameter/(mm) upper pressing roller | inter-axial distance (mm) | maximum shearing strain | surface pressure (kPa) | nipping number to destruction |
|---|---|---|---|---|---|---|---|---|
| Comparative Example 1 | 10 | 25 | 50 | 60 | 51.3 | 0.54 | 230 | 1150000 |
| Comparative Example 2 | 10 | 35 | 50 | 60 | 51.3 | 0.53 | 240 | 2250000 |
| Comparative Example 3 | 12.5 | 30 | 50 | 60 | 51.1 | 0.53 | 230 | 2550000 |
| Example 1 | 15 | 30 | 50 | 60 | 51.3 | 0.49 | 200 | 4900000 |
| Example 2 | 10 | 30 | 60 | 60 | 56.7 | 0.48 | 180 | 6500000 |
| Example 3 | 15 | 30 | 60 | 60 | 56.7 | 0.35 | 140 | 10500000 |

of print media to be used. In the case of a regular paper sheet, as having already described, even if the surface pressure becomes high, image quality is not influenced. Accordingly, the maximum shearing strain may be set to become 0.50 or less. However, in order to improve the durability more, the surface pressure may be set such that the fixing performance is sufficient for the regular paper sheet. Accordingly, it is preferable that the maximum shearing strain is made to become less than 0.31. On the other hand, in the case of a coated paper sheet, the maximum shearing strain is made to 0.31 to 0.50. For this purpose, as having already described in the embodiment, it is to dispose the roller position changer 370.

The maximum shearing strain is adjusted not only by the control of a peak surface pressure, but also by setting at a design stage. For example, a roller diameter, the hardness of a foam body 3612, the thickness of a foam body 3612, etc. are designed such that the maximum shearing strain may become a value of 0.5 or less in the case where a peak surface pressure is 80 to 400 kPa.

According to the embodiment and example described in the above, the following effects are attained.

In the embodiment and the example, the upper pressing roller 361 (the first pressing roller) including the core metal 3611 and the foam body 3612 is used in the fixing apparatus. Then, the peak surface pressure of the nip portion 380 is made to be changed correspondingly to the kind of print media, for example, a difference whether a print media is a regular paper sheet or a coated paper sheet such that a range where the maximum shearing strain occurs from the interface between this core metal 3611 and the foam body 3612 in the foam body 3612, becomes a predetermined range. With this, the life of the roller using the foam body 3612 can be made longer, and the durability of the fixing apparatus can be improved.

Although the embodiment and the example applied the present invention have been described in the above, the present invention should not be limited to these embodiment and example.

In the above-described embodiment and example, as an apparatus constitution, the upper pressing roller 361 (the first pressing roller) is made a roller including the core metal 3611 and the foam body 3612 covering the core metal 3611. Instead of this, the lower pressing roller 362 (the second pressing roller) may be made a roller including the core metal 3611 and the foam body 3612 covering the core metal 3611. This is because the surface pressure applied to the nip portion 380 is a pressure applied between the upper pressing roller 361 and the lower pressing roller 362. From this, also in the case of a constitution that uses the foam body 3612 for the lower pressing roller 362, similarly to the already-described embodiment and example, by making the peak surface pressure changeable such that the maximum shearing strain becomes a value of 0.5 or less in the case where the peak surface pressure is 80 to 400 kPa, it is possible to improve durability.

Moreover, the present embodiment has been described in such a manner that, from the experimental results in the examples, it is preferable to make the maximum shearing strain become a value of 0.5 or less in the case where the peak surface pressure is 80 to 400 kPa. However, this value of the maximum shearing strain may be set appropriately correspondingly to target durability (the number of times of nipping). For example, in the case where it is wanted to improve the durability more, the maximum shearing strain may be set to a value lower than 0.5, for example, to 0.45 or less, further to 0.40 or less. Conversely, in the case where it is wanted to fix with a higher pressure even if the durability becomes a little inferior, the maximum shearing strain may be set to a value exceeding 0.5, for example, to 0.52 or less. Of course, these values are merely one example, and the position of the lower pressing roller (the second pressing roller) may be adjusted in order to adjust a peak surface pressure such that the maximum shearing strain becomes within a range of a predetermined maximum shearing strain.

Moreover, the present invention can be applied not only to an image forming system like the production printing machine shown in the embodiment, but also to any image forming apparatus including an image former and a fixing apparatus.

In addition, the present invention can be modified variously on the basis of the constitution described in the claims, and such modification is included within the scope of the present invention.

Although embodiments of the present invention have been described and illustrated in detail, the disclosed embodiments are made for purpose of illustration and example only and not limitation The scope of the present invention should be interpreted by terms of the appended claims.

What is claimed is:

1. A fixing apparatus, comprising:

a first pressing roller;

a belt wound around the first pressing roller;

a second pressing roller disposed so as to face the first pressing roller across the belt and to form a fixing nip portion between itself and the belt; and a roller position changer that changes a position of the second pressing roller, wherein at least one of the first pressing roller and the second pressing roller includes a core metal and a foam body covering the core metal, and wherein the roller position changer changes a position of the second pressing roller so as to be able to change a peak surface pressure of the fixing nip portion correspondingly to a kind of a print medium, and such that the peak surface pressure corresponds to a maximum shearing strain, measured in a stationary state, of 0.50 or less, wherein in a case where a line connecting a rotation center of the first pressing roller to a rotation center of the second pressing roller is made an imaginary line segment, a range where the maximum shearing strain occurs is a range between a line segment drawn from a center of the roller including the foam body in a direction at 45 degrees on a upstream side in a rotation direction of the roller with respect to the imaginary line segment and a line segment drawn from the center of the roller in a direction at 45 degrees on a downstream side, and wherein the maximum shearing strain occurs from an interface between the core metal and the foam body in the foam body.

2. The fixing apparatus according to claim 1, wherein the peak surface pressure is 80 kPa or more and less than 120 kPa in a case where a kind of the print medium is a regular paper sheet, or, is 120 kPa or more and 400 kPa or less in a case where a kind of the print medium is a coated paper sheet.

3. The fixing apparatus according to claim 1, wherein a width of the fixing nip portion is 16 to 30 mm.

4. The fixing apparatus according to claim 1, wherein the foam body includes continuous air bubbles with a cell diameter of 1 to 50 μm.

5. The fixing apparatus according to claim 1, wherein in the foam body, a thickness, from the interface to a surface of the roller, of the foam body is 10 to 30 mm.

6. The fixing apparatus according to claim 1, wherein an outside diameter of each of the first pressing roller and the second pressing roller is 50 to 70 mm.

7. An image forming apparatus, comprising:

an image former that forms a toner image on a print medium;

the fixing apparatus according to claim 1 that fixes the toner image formed by the image former onto the print medium; and a processor, which is configured to:

discriminate the kind of the print medium; and control the roller position changer to change the position of the second pressing roller to change a peak surface pressure of the fixing nip portion in accordance with the kind of the print medium and such that the peak surface pressure corresponds to the maximum shearing strain, measured in a stationary state, of 0.50 or less.

8. A method of controlling a fixing apparatus that includes a first pressing roller, a belt wound around the first pressing roller, and a second pressing roller disposed so as to face the first pressing roller across the belt and to form a fixing nip portion between itself and the belt, wherein at least one of the first pressing roller and the second pressing roller includes a core metal and a foam body covering the core metal, the method comprising:

changing a position of the second pressing roller to change a peak surface pressure of the fixing nip portion in accordance with a kind of a print medium passing through the fixing nip portion and such that the peak surface pressure corresponds to a maximum shearing strain, measured in a stationary state, of 0.50 or less, wherein the maximum shearing strain occurs from an interface between the core metal and the foam body in the foam body, and wherein, in a case where a line connecting from a rotation center of the first pressing roller to a rotation center of the second pressing roller is made an imaginary line segment, a range where the maximum shearing strain occurs is a range between a line segment drawn from a center of the roller including the foam body in a direction at 45 degrees on a upstream side in a rotation direction of the roller than the imaginary line segment and a line segment drawn from the center of the roller in a direction at 45 degrees on a downstream side.

* * * * *